US005989701A

United States Patent [19]

Goetzen et al.

[11] Patent Number: 5,989,701

[45] Date of Patent: Nov. 23, 1999

[54] RECORDING MATERIAL FOR THE INKJET PROCESS

[75] Inventors: Klaus Goetzen, Dueren; Axel Niemoeller, Dueren-Niederau, both of Germany

[73] Assignee: Sihl GmbH, Dueren, Germany

[21] Appl. No.: 08/935,663

[22] Filed: Sep. 23, 1997

[30] Foreign Application Priority Data

Mar. 10, 1997 [DE] Germany ..... 197 09 735

[51] Int. Cl.[6] ..... B41M 5/00

[52] U.S. Cl. ..... 428/327; 428/315.9; 428/514; 523/161; 523/218; 524/503; 524/542

[58] Field of Search ..... 523/161, 218, 523/503; 428/327, 514, 315.9

[56] References Cited

U.S. PATENT DOCUMENTS

| | | | |
|---|---|---|---|
| 4,460,637 | 7/1984 | Miyamoto et al. | 428/327 |
| 4,780,356 | 10/1988 | Otouma et al. | 428/212 |
| 4,877,686 | 10/1989 | Riou et al. | 428/514 |
| 4,892,787 | 1/1990 | Kruse et al. | 428/514 |
| 5,141,599 | 8/1992 | Jahn et al. | 162/137 |
| 5,360,780 | 11/1994 | Okumura et al. | 503/227 |
| 5,411,787 | 5/1995 | Kulkarni et al. | 428/327 |
| 5,460,874 | 10/1995 | Rao | 428/327 |
| 5,747,148 | 5/1998 | Warner et al. | 428/327 |

FOREIGN PATENT DOCUMENTS

| | | |
|---|---|---|
| 184529 | 6/1986 | European Pat. Off. . |
| 370441 | 5/1990 | European Pat. Off. . |
| 445327 | 9/1991 | European Pat. Off. . |
| 709 223 | 5/1996 | European Pat. Off. . |
| 709223 | 5/1996 | European Pat. Off. . |
| 743 193 | 11/1996 | European Pat. Off. . |
| 743193 | 11/1996 | European Pat. Off. . |
| 44 46 551 | 12/1994 | Germany . |
| 4446551 | 12/1994 | Germany . |

*Primary Examiner*—Andrew E. C. Merriam
*Attorney, Agent, or Firm*—Keil & Weinkauf

[57] ABSTRACT

The invention relates to a recording material for the inkjet process, having a sheet-like substrate layer and at least one porous recording layer which is arranged on at least one side of the substrate layer and contains a binder combination comprising a film-forming plastics dispersion and a film-forming water-soluble polymer and from 30 to 90 k by weight, based on the dry recording layer, of an organic pigment which consists of porous particles or of primary particles which form porous agglomerates and has a mean pore diameter of from 0.1 to 0.5 $\mu$m, an internal pore volume of from 1.0 to 4.0 $cm^3/g$, an oil absorption (DBP) of from 200 to 350 ml/100 g and a mean diameter of the porous particles or of the porous agglomerates of from 1 to 30 $\mu$m, the ratio of pigment to binder being from 0.5:1 to 2:1. The recording material is particularly suitable for use with pigmented ink.

19 Claims, No Drawings

RECORDING MATERIAL FOR THE INKJET PROCESS

BACKGROUND OF THE INVENTION

1. Field of the Invention

The present invention relates to a recording material for the inkjet process, in particular for use with solvent-based pigmented inks.

2. Related Background Art

The inkjet process is now a widely used printing process since it can be carried out using relatively simple printers without noise and with high quality, in particular in the case of color printing. In the inkjet process, droplets of a recording fluid, the ink, are applied to the recording material by various techniques (for example continuous method, drop-on-demand method, such as piezoelectric or bubble jet method). With increasing improvement of the mode of operation of inkjet printers, increasingly high requirements are being set for the recording materials. The recording produced by means of inkjet processes is required to have, for example, high resolution, high color density, sufficient ink gradations and good smear resistance, as well as water resistance and lightfastness.

A recording material for the inkjet process consists as a rule of a substrate and an ink-receptive or recording layer arranged thereon. The recording layer frequently consists of a pigment/binder mixture. In addition to increasing the whiteness of the material, the pigments serve for retention of the colorants from the ink on the surface of the sheet.

European Patent 0 445 327 relates to a recording material having a glossy surface for the inkjet process, comprising a polyolefin-coated base paper and an ink-receptive layer which contains a mixture of gelatine and starch as binder. In one embodiment, the ink-receptive layer additionally contains not more than 5.9% by weight of a porous organic pigment which is a reactive urea/formaldehyde condensate containing methylol groups. The printed images produced have good color density and high abrasion resistance. Although the images are also described as "water-resistant", this "water resistance" is by no means sufficient for the use of the recording material outdoors since the ink-receptive layer itself consists for the most part of water-soluble or water-swellable components. Furthermore, the coating is not highly porous and is suitable only for aqueous inks.

U.S. Pat. No. 4,877,686 describes a recording sheet for inkjet printing which consists of an opaque base sheet and a coating which contains a polyhydroxylic polymer gelled with boric acid or a boric acid derivative, as a binder, and a filler. Inter alia, melamine/formaldehyde pigments are mentioned as possible fillers. Images produced on this recording sheet consist of circular uniform dots.

U.S. Pat. No. 5,081,470 discloses a recording medium for the inkjet process, comprising a substrate and an ink-receptive layer which contains at least 60% by weight of a pigment of a magnesium compound, and a binder. Binders which may be used are water-soluble polymers and water-dispersible polymers alone or in combination. In addition to the magnesium-containing pigments, organic pigments may, inter alia, additionally be present for increasing the ink absorption. The recorded image has good stability, in particular to discoloration, and high optical density.

WO 93/04870 relates to a transparent image-recording element for the inkjet process, which consists of a substrate and an ink-receptive layer, the ink-receptive layer containing a vinylpyrrolidone, disperse polyester particles having a diameter of less than 1 $\mu$m, a homopolymer or copolymer of an alkylene oxide, a polyvinyl alcohol, a surfactant and from 0.5 to 1.5% by weight of inert particles having a diameter of 3–25 $\mu$m. The inert particles may be organic particles, such as, for example, polymer beads. The ink-receptive layer is capable of controlling the dot size, and the recorded image has improved optical density.

U.S. Pat. No. 4,460,637 discloses an inkjet recording sheet having a support and one or more ink-receptive layers thereon, the ink-receptive layer consisting of a binder and agglomerates of 1–50 $\mu$m in average diameter produced by agglomerating primary particles of not more than 0.20 $\mu$m in average diameter. The pore radius distribution curve of the pores which are present between the primary particles, i.e. within the agglomerates, has a maximum at 0.05 $\mu$m or less. In addition to inorganic pigments, synthetic organic pigments are also mentioned as suitable primary particles. The recorded image is characterized by high ink density and luminous colors and is suitable for multicolor printing.

The abovementioned recording materials are suitable for use with inks which contain soluble dyes. However, for pigmented inks which have, inter alia, the advantage that the images produced therewith are lightfast and hence suitable for outdoor use, no optimal recording materials are known to date. Water-based pigmented inks, solvent-based pigmented inks and wax-based pigmented inks (fusible inks) are known.

SUMMARY OF THE INVENTION

It is therefore the object of the present invention to provide, for the inkjet process, a recording material which, with pigmented inks, in particular solvent-based inks and wax inks, gives water-resistant images of good quality and stability, which are also suitable for outdoors.

The object is achieved by a recording material for the inkjet process, having a sheet-like substrate layer and at least one porous recording layer which is arranged on at least one side of the substrate layer and contains a binder combination comprising a film-forming plastics dispersion and a film-forming water-soluble polymer and from 30 to 900% by weight, based on the dry recording layer, of an organic pigment which consists of porous particles or of primary particles which form porous agglomerates and has a mean pore diameter of from 0.1 to 0.5 $\mu$m, an internal pore volume of from 1.0 to 4.0 $cm^3/g$, an oil absorption (DBP) of from 200 to 350 ml/100 g and a mean diameter of the porous particles or of the porous agglomerates of from 1 to 30 $\mu$m, the ratio of pigment to binder being from 0.5:1 to 2:1.

The invention furthermore relates to a process for the production of a single-color or multicolor resistant recording by application of pigmented solvent-containing or wax-like ink(s) to abovementioned recording material.

DETAILED DESCRIPTION OF THE PREFERRED EMBODIMENTS

The present invention will be described in detail below, referring to preferred embodiments.

The binder in the recording layer according to the invention consists of a combination of a film-forming plastics dispersion and of a film-forming water-soluble polymer.

The polymer of the film-forming plastics dispersion preferably has a glass transition temperature of from −10° C. to +70° C., more preferably from −5 to +30° C. All film-forming plastics dispersions which are usually used as binders in recording layers, for example dispersions of polyurethane, polyvinyl acetate, polyvinyl acetate copolymers, styrene/butadiene copolymers, styrene/butadiene/acrylonitrile terpolymers, styrene/(meth)acrylate copolymers, (meth)acrylic polymers, ethylene/(meth)acrylic acid copolymers, ethylene and vinyl chloride copolymers and mixtures thereof, may be used in the binder combination. The polymer of the film-forming plastics dispersion is preferably used in an amount of from 5 to 60% by weight, more preferably from 30 to 50% by weight, based in each case on the dry recording layer.

The other component of the binder combination is a film-forming water-soluble polymer. Here too, all water-soluble polymers whose use as binders in recording layers is known may in principle be used, but the water-soluble polymer is preferably crosslinkable via hydroxyl groups. Suitable examples include polyvinyl alcohol, water-soluble methacrylates containing hydroxyl groups and copolymers thereof, water-soluble cellulose derivatives, such as, for example, hydroxyethylcellulose, and water-soluble starch derivatives and mixtures thereof. The water-soluble polymer is preferably used in an amount of from 5 to 60% by weight, more preferably from 10 to 30% by weight, based in each case on the dry recording layer.

In addition to the binder combination, the recording layer may additionally contain a suitable crosslinking agent in order to increase the water resistance of the coating. Suitable crosslinking agents are, for example, glyoxal, glyoxal resins, melamine/formaldehyde resins, urea/formaldehyde resins, polyisocyanates, polyepoxides and polyaziridines. The crosslinking agent is preferably used in an amount of from 1 to 20% by weight, based on the dry recording layer, from 2 to 7% by weight being particularly preferred.

The recording layer contains, as an essential component, an organic pigment which consists of porous particles or of small primary particles which form porous agglomerates, the porous particles or porous agglomerates having a mean diameter of from 1 to 30 $\mu$m, preferably from 1 to 15 $\mu$m, a mean pore diameter of from 0.1 to 0.5 $\mu$m, preferably from 0.3 to 0.4 $\mu$m, an internal pore volume of from 1.0 to 4.0 $cm^3/g$, preferably from 2 to 3 $cm^3/g$ and an oil absorption (DBP (dibutyl phthalate)) of from 200 to 350 ml/100 g, preferably from 290 to 300 ml/100 g. The organic pigment may be, for example, a polyamide copolymer, a crosslinked polystyrene resin, a urea/formaldehyde resin or a melamine/formaldehyde resin. A melamine/formaldehyde resin having up to 2% by weight of reactive methylol groups is preferred. If the organic pigment consists of porous agglomerates of primary particles, the mean diameter of these primary particles is preferably from 0.05 to 0.3 $\mu$m, more preferably from 0.10 to 0.15 $\mu$m.

A particularly advantageous embodiment of the present invention contains an organic pigment which consists of a urea/formaldehyde condensate with on average about 0.6% by weight of reactive methylol groups and has primary particles of a size from 0.1 to 0.15 $\mu$m which form agglomerates having a mean particle size of about 6 $\mu$m. The porous agglomerates have an internal pore volume of about 2.7 $cm^3/g$ and an average diameter (as assumed capillary) of from 0.3 to 0.4 $\mu$m. The oil absorption (DBP) is from 290 to 300 $cm^3/100$ g and the specific surface area is 20±3 $m^2/g$ (BET method). The nitrogen content is about 33% by weight and the organic pigment has a positive zeta potential in a pH range from 4.5 to 7.5.

Depending on the use of the recording material, the ratio of pigment to binder in the recording layer may be varied in the range from 0.5:1 to 2:1. The pigment/binder ratio can be used to adjust not only the mechanical strength of the coating, for example with regard to scratch resistance, abrasion resistance or water resistance, but also the size of the ink dot. Ink dots which are as small as possible or as large as possible or ink dot sizes which are optimally adapted to the mechanical resolution and the ink drop volume are required, depending on the use. As a rule, the ink dots are larger the smaller the amount of binder used, i.e. the larger the pigment/binder ratio.

In addition to the components already mentioned, the recording layer may contain further auxiliary agents, such as, for example, fungicides, dyes, inorganic pigments, lubricants, dispersants, antifoams and optical brighteners.

The recording layer according to the invention is water-resistant, with the result that the recording material is suitable in particular also for applications outdoors.

The sheet-like substrate layer of the recording material according to the invention, on which at least one porous recording layer is applied to at least one side, may consist of different materials.

A suitable substrate material is paper having a basis weight of from 50 to 250 $g/m^2$, optionally also containing wet strength agents. Paper may contain a filler such as calcium carbonate, kaolin or an organic pigment, porous organic pigments also being suitable and it being possible to use the same pigments as in the recording layer. The filler content is preferably not more than 25% by weight, based on dry matter. Papers having a surface smoothness of from 20 to 200 Bekk.s, internal and/or surface sizing with known sizes and a Cobb degree of sizing of from 2 to 100 $g/m^2$ in 60 s are particularly preferred. The back of the paper may be provided with the porous recording layer, like the front, or may have a barrier layer against solvents, for example comprising a plastics dispersion, or a coating for lay-flat properties, for example comprising polyvinyl chloride or soluble starch derivatives. Except when recycled paper is used, the whiteness of the paper should be as high as possible.

In addition to paper, a film is also suitable as material for the substrate layer; it may be transparent, white or translucent and may consist, for example, of polyethylene glycol terephthalate (PET), polypropylene (PP), polyvinyl chloride (PVC), polyimide (PI) or polyethylene (PE).

Synthetic or semisynthetic papers with or without cellulose fibers, such as, for example, those sold under the brands PRETEX®, NEOBOND® and TYVEK®, are also suitable.

A laminated material comprising paper and film may also be used for the substrate layer.

Depending on the intended use of the recording material, a pressure sensitive adhesive coating or a silicone paper may be applied to the back of the substrate layer.

The recording layer is preferably applied to the substrate layer in a thickness of from 3 to 60 $g/m^2$; if the substrate layer is a paper, a thickness of from 3 to 12 $g/m^2$ is preferred. Two recording layers may be applied one on top of the other, it being possible to use organic pigments having different pore sizes.

The recording layer is applied to the substrate material by means of a conventional coating method, but preferably from aqueous dispersion by roller application with metering, for example by means of a knife coater, air brush, nozzle coating, doctor blade or reverse roll coating. As already mentioned, the coating may be applied twice, also as a coating on both sides. The recording layer is then dried, preferably at from 50 to 120° C. in a hot-air dryer.

The recording material according to the invention is particularly suitable for the use with pigmented, preferably solvent-containing or waxy fusible ink. The single-color or multicolor recording produced using pigmented ink or a plurality of inks in different colors is water-resistant. Butyl acetate, higher aliphatic straight-chain or branched hydrocarbons ($C_8$ to $C_{20}$), higher aliphatic straight-chain or branched alcohols ($C_{10}$ to $C_{20}$), lower alcohols and glycols and mixtures thereof are particularly suitable as solvents for the pigmented ink. The ink viscosity for use in a printer having piezoelectric printing heads (amounts of ink from about 30 to 60 pl/drop) is preferably from 6 to 30 mPa.s and the surface tension from 20 to 45 mN/m. The mean diameter of the pigment particles in the ink is preferably in the range from 30 to 180 nm, it being possible for oligomers or polymers chemically bonded to the pigment surface and having affinity to the solvent to be present as stabilizers. Conventional colorants for the pigmented ink have the CMYK colors cyan, magenta, yellow and black or spot colors (special colors). Suitable colorants are finely divided carbon black, Pigment Blue 15, Pigment Red 23, Pigment Red 122, Pigment Yellow 14 and Pigment Yellow 128 (according to the Color Index).

A print produced with a pigmented ink in the inkjet process on the recording material according to the invention consists of very small dots of defined size and therefore has high brilliance and crispness. The recording is lightfast and water-resistant and has high abrasion resistance and aging resistance, even after prolonged action of water, and is therefore particularly suitable for outdoor uses. A further advantage is the short drying time of the ink on the recording material according to the invention.

The advantageous properties of the recording material according to the invention are partly due to the fact that the special pigments in the recording layer permit exact fixing of the colored pigments of the ink. The very high color brilliance of the recordings on the recording material according to the invention is due, inter alia, to the fact that the solvent or the wax of the ink penetrates into those pores of the pigment which have a mean pore diameter of from 0.1 to 0.5 $\mu$m and thus makes the recording layer optically transparent.

The high quality of the prints produced on the recording material according to the invention by means of inkjet processes using pigmented ink makes the recording material suitable for a very wide range of applications, for example for photographic and graphic images, for example in the areas of advertising and trade fair design (posters), for presentations (substrate material: white film) and for outdoor uses (billboard paper, high wet strength), of course also depending on the substrate material used. Special applications are covered by back-lit films (substrate material: translucent or transparent film), which are to be viewed from the printed side or from the back in the case of reversed print, pressure sensitive adhesive films (substrate material: e.g. PVC film with pressure sensitive adhesive coating and silicone paper on the back) for adhesive bonding of various surfaces outdoors, for example for advertising, signs and labels, and papers having high water resistance (substrate material synthetic or semisynthetic paper) for safety applications, building plans and cards and for stretched tapes (for example of Tyvek®) which are put up as advertising surfaces outdoors.

The invention is illustrated below with reference to Examples, but the invention is not limited thereto.

EXAMPLE 1

Production of a recording material according to the invention having paper as a substrate layer:

A base paper having a basis weight of 90 g/m$^2$, 12% by weight of calcium carbonate as filler, a surface size comprising modified starch, a Cobb degree of sizing of 20 g/m$^2$ in 60 s and a surface smoothness of 80 Bekk.s is coated on one side by means of a rotating doctor blade with a uniform, dull coating of the following composition:

Composition of the recording layer:

| | | |
|---|---|---|
| Water | 180 g | |
| Pergopak ® M2[(1)] | 30 g | |
| Mowiol ® 28/99[(2)] | 80 g | of a 10% strength by weight solution |
| Vinnapas ® DPN 36[(3)] | 40 g | of a 52% strength by weight dispersion |
| Glyoxal | 4 g | |
| Optical brightener | 0.2 g | |
| Nonionic crosslinking agent | 0.5 g | |

[(1)]Pergopak ® M2 from Martinswerke, Germany, is an organic pigment which consists of a urea/formaldehyde condensate with on average about 0.6% by weight of reactive methylol groups and has primary particles of a size from 0.1 to 0.15 $\mu$m which form agglomerates having a mean particle size of about 6 $\mu$m. The porous agglomerates have an internal pore volume of about 2.7 cm$^3$/g and an average diameter (as assumed capillary) of from 0.3 to 0.4 $\mu$m.The oil absorption (DBP) is from 290 to 300 cm$^3$/100 g and the specific surface area is 20 ± 3 m$^2$/g (BET method). The nitrogen content is about 33% by weight and the organic pigment has a positive zeta potential in a pH range from 4.5 to 7.5.

[(2)]Mowiol ® 28/99 from Hoechst, Germany, is a polyvinyl alcohol having a degree of hydrolysis of 99%.

[(3)]Vinnapas ® DPN 36 from Wacker, Germany, is a copolymer of vinyl acetate.

(1) Pergopak® M2 from Martinswerke, Germany, is an organic pigment which consists of a urea/formaldehyde condensate with on average about 0.6% by weight of reactive methylol groups and has primary particles of a size from 0.1 to 0.15 $\mu$m which form agglomerates having a mean particle size of about 6 $\mu$m. The porous agglomerates have an internal pore volume of about 2.7 cm$^3$/g and an average diameter (as assumed capillary) of from 0.3 to 0.4 $\mu$m. The oil absorption (DBP) is from 290 to 300 cm$^3$/100 g and the specific surface area is 20±3 m$^2$/g (BET method). The nitrogen content is about 33% by weight and the organic pigment has a positive zeta potential in a pH range from 4.5 to 7.5.

(2) Mowiol® 28/99 from Hoechst, Germany, is a polyvinyl alcohol having a degree of hydrolysis of 99%.

(3) Vinnapas® DPN 36 from Wacker, Germany, is a copolymer of vinyl acetate.

The dry coat obtained after drying at 90° C. in a drying oven amounts to 7.0 g/m$^2$, determined by weighing uncoated and coated paper and calculating the difference.

EXAMPLE 2

Production of a recording material according to the invention, having white PVC film as a substrate layer:

A white flexible PVC film coated on one side with a pressure sensitive adhesive and laminated with silicone paper is coated on the opposite side, by means of a knife coater, with a uniform, dull coating having the composition shown in Example 1, only 140 g of water being used instead of 180 g of water.

The dry coat obtained after drying at 90° C. in a drying oven amounts to 45 g/m$^2$, determined by weighing uncoated and coated film and calculating the difference. The recording layer adheres firmly to the substrate film and is scratch-resistant.

EXAMPLE 3

Production of a recording material according to the invention, having transparent PET film as a substrate layer:

A transparent PET film antistatic on one side is coated on the opposite side, by means of a knife coater, with a uniform, dull coating having the composition shown in Example 1, only 140 g of water being used instead of 180 g of water.

The dry coat obtained after drying at 90° C. in a drying oven amounts to 60 g/m$^2$, determined by weighing uncoated and coated film and calculating the difference. The recording layer adheres firmly to the substrate film, is scratch-resistant and imparts an opacity of 0.45, measured according to ISO 2471 with a transmitted light densitometer TD 528 from McBeth, to the recording material obtained.

EXAMPLE 4

Printing on the recording materials from Examples 1 to 3:

The recording materials obtained in Examples 1 to 3 are printed in color by means of an inkjet printer having piezoelectric printing heads (EPSON Stylus Color) using an ink which essentially comprises an organic solvent of high-boiling aliphatics (Isopar® V from Esso) and organic colored pigments in the colors cyan, magenta, yellow and black. Brilliant, high-contrast and crisp colored images are obtained in each case. The ink is absorbed instantaneously into the recording layer, the colored pigments being fixed essentially in the layer so that smearing directly after printing is not possible. The color contrast of the recording, measured as optical density, is more than 1.0 for all primary colors (measured using a reflected light densitometer RD 920 from McBeth). After the prints had been stored for 24 h in cold water and dried again in air at room temperature, no substantial differences can be found relative to the original print. The printed image is thus water resistant.

The recording material from Example 1 is alternatively printed with wax inks, similarly good results being obtained. Wax-containing pigmented ink in the colors cyan, magenta, yellow and black are applied by means of inkjet heads which operate according to the piezoelectric principle, using a printer of the type DisplayMaker Express from LaserMaster. In an aftertreatment step, the recording material with the ink is heated to about 95° C. in order to achieve a brilliant printed image and good adhesion. During this procedure, the ink penetrates into the recording layer and partly also into the substrate paper. Brilliant, high-contrast and crisp color images whose scratch resistance is substantially improved compared with an uncoated paper are obtained. The printed image is water-resistant according to the test method described above.

Owing to the colored pigments in the inks used, all prints have high resistance to UV irradiation, in contrast to prints comprising inks which contain soluble dyes. Thus, only small changes in the colors and color contrast are found on irradiation for 144 hours using a Suntester from Haereus.

The printed recording material from Example 2 can be adhesively bonded to any desired smooth surfaces after the silicon paper has been peeled off.

When viewed in transmitted light on a light box, the printed recording material from Example 3 achieves high contrast and brilliant colors without the illuminating elements being visible.

We claim:

1. A recording material for an inkjet process, said recording material comprising a sheet-like substrate layer having two sides and at least one porous recording layer arranged on at least one side of the substrate layer; said recording layer comprising a binder combination and from 30 to 90% by weight, based on the dry recording layer, of an organic pigment comprising porous particles or primary particles which form porous agglomerates, said porous particles or porous agglomerates having a mean pore diameter of from 0.1 to 0.5 μm, an internal pore volume of from 1.0 to 4.0 cm$^3$/g, an oil absorption (DBP) of from 200 to 350 ml/100 g, and a mean diameter of from 1 to 30 μm; said binder combination comprising from 5 to 60% by weight, based on the dry recording layer, of a film-forming water-soluble polymer, and from 5 to 60% by weight, based on the dry recording layer, of a film-forming plastics dispersion comprising a polymer, the polymer of the film-forming plastics dispersion having a glass transition temperature of from −10° C. to +70° C.

2. The recording material of claim 1, wherein the film-forming plastics dispersion is selected from the group consisting of dispersions of a polyurethane, a polyvinyl acetate, a polyvinyl acetate copolymer, a styrene/butadiene copolymer, a styrene/butadiene/acrylonitrile terpolymer, a styrene/(meth)acrylate copolymer, a (meth)acrylic polymer, an ethylene/(meth)acrylic acid copolymer, and an ethylene and vinyl chloride copolymer, and mixtures thereof.

3. The recording material of claim 1, wherein the film-forming water-soluble polymer of the binder combination is selected from the group consisting of a polyvinylalcohol, a water-soluble (meth)acrylate containing hydroxyl groups and a copolymer thereof, a water-soluble cellulose and starch derivative, and mixtures thereof.

4. A recording material for an inkjet process, said recording material comprising a sheet-like substrate layer having two sides and at least one porous recording layer arranged on at least one side of the substrate layer; said recording layer comprising a binder combination, 30 to 90% by weight, based on the dry recording layer, of an organic pigment, and a crosslinking agent, said binder combination comprising from 5 to 60% by weight, based on the dry recording layer, of a film-forming water-soluble polymer; and from 5 to 60% by weight, based on the dry recording layer, of a film-forming plastics dispersion;

said organic pigment comprising porous particles or primary particles which form porous agglomerates, said porous particles or porous agglomerates having a mean pore diameter of from 0.1 to 0.5 μm, an internal pore volume of from 1.0 to 4.0 cm$^3$/g, an oil absorption (DBP) of from 200 to 350 ml/100 g, and a mean diameter of from 1 to 30 μm;

said crosslinking agent being selected from the group consisting of glyoxal, a glyoxal resin, a melamine/formaldehyde resin, a urea/formaldehyde resin, a polyisocyanate, a polyepoxide and a polyaziridine.

5. The recording material of claim 4, wherein the recording layer comprises from 1 to 22% by weight of the crosslinking agent.

6. The recording material of claim 4, wherein the organic pigment is selected from the group consisting of a polyamide copolymer, a crosslinked polystyrene resin, a urea/formaldehyde resin and a melamine/formaldehyde resin.

7. The recording material of claim 1 wherein the porous particles or porous agglomerates have a mean diameter of from 1 to 15 μm and the dry weight ratio of pigment to binder is from 0.5:1 to 2:1.

8. The recording material of claim 1, wherein the organic pigment is a melamine/formaldehyde resin and contains up to 2% by weight of reactive methylol groups.

9. The recording material as claimed in claim 1, wherein the mean diameter of the porous particles or porous agglomerates is from 1 to 10 μm.

10. The recording material of claim 1, wherein the organic pigment forms porous agglomerates of primary particles having a mean diameter of from 0.05 to 0.3 $\mu$m.

11. The recording material as claimed in claim 1, wherein the porous recording layer contains further auxiliary agents selected from fungicides, dyes, inorganic pigments, lubricants, dispersants, antifoams and optical brighteners.

12. The recording material of claim 1, wherein the substrate layer is selected from paper, synthetic paper, synthetic polymer film, and laminated material comprising paper and synthetic polymer film.

13. A process for the production of single-color or multicolor resistant recording by application of pigmented solvent-containing or-waxy ink(s) to the recording material of claim 1.

14. The recording material of claim 1, wherein the substrate layer is paper containing wet strength agents.

15. The recording material of claim 1, wherein the substrate layer is a synthetic paper without cellulose fibers.

16. The recording material of claim 1, wherein the substrate layer is synthetic paper comprising cellulose fibers.

17. The recording material of claim 1, wherein the substrate layer is a synthetic polymer film selected from polyethylene glycol terephthalate (PET), polypropylene (PP), polyvinyl chloride (PVC), polyimide (PI) and polyethylene (PE).

18. The recording material of claim 1, wherein the substrate layer arranged on the side opposite to the recording layer comprises a pressure sensitive coating which is covered by a silicon paper as liner.

19. A recording material for an inkjet process, said recording material comprising a sheet-like substrate layer having two sides and at least one porous recording layer arranged on at least one side of the substrate layer; said recording layer comprising a binder combination and from 30 to 90% by weight, based on the dry recording layer, of an organic pigment comprising porous particles or primary particles which form porous agglomerates, said porous particles or porous agglomerates having a mean pore diameter of from 0.1 to 0.5 $\mu$m, an internal pore volume of from 1.0 to 4.0 $cm^3/g$, an oil absorption (DBP) of from 200 to 350 ml/100 g, and a mean diameter of from 1 to 30 $\mu$m; said organic pigment being a melamine/formaldehyde resin comprising up to 2% by weight of reactive methylol groups; and said binder combination comprising from 5 to 60% by weight, based on the dry recording layer, of a film-forming water-soluble polymer; and from 5 to 60% by weight, based on the dry recording layer, of a film-forming plastics dispersion.

* * * * *

UNITED STATES PATENT AND TRADEMARK OFFICE

CERTIFICATE OF CORRECTION

PATENT NO.: 5,989,701

DATED: November 23, 1999

INVENTOR(S): GOETZEN et al.

It is certified that error appears in the above-identified patent and that said Letters Patent is hereby corrected as shown below:

In the abstract, line 6, "90 k" should be --90 %--.

Col. 8, claim 7, after "claim 1" insert a comma --,--.

Col. 8, claim 9, line 65, delete "as claimed in" and substitute --of--.

Col. 9, claim 11, line 4, delete "as claimed in" and substitute --of--.

Signed and Sealed this

Fourth Day of July, 2000

*Attest:*

Q. TODD DICKINSON

*Attesting Officer*

*Director of Patents and Trademarks*